US007284580B2

(12) United States Patent
Dallison et al.

(10) Patent No.: US 7,284,580 B2
(45) Date of Patent: Oct. 23, 2007

(54) LIQUID DISPENSING

(75) Inventors: Anne Elizabeth Dallison, Woodborough (GB); Shaun Harrison, Nottingham (GB)

(73) Assignee: Boots Healthcare International Limited, Nottingham (GB)

( * ) Notice: Subject to any disclaimer, the term of this patent is extended or adjusted under 35 U.S.C. 154(b) by 137 days.

(21) Appl. No.: 10/534,409

(22) PCT Filed: Nov. 10, 2003

(86) PCT No.: PCT/GB03/04850

§ 371 (c)(1),
(2), (4) Date: May 11, 2005

(87) PCT Pub. No.: WO2004/043326

PCT Pub. Date: May 27, 2004

(65) Prior Publication Data

US 2006/0027282 A1 Feb. 9, 2006

(30) Foreign Application Priority Data

Nov. 12, 2002 (GB) ..... 0226347.3

(51) Int. Cl.
*B65B 1/04* (2006.01)

(52) U.S. Cl. ..... 141/319; 141/2; 141/27; 141/383; 141/386; 604/407

(58) Field of Classification Search ..... 141/2, 141/18, 27, 318–322, 383, 386; 215/50; 604/407, 905
See application file for complete search history.

(56) References Cited

U.S. PATENT DOCUMENTS

| | | | | |
|---|---|---|---|---|
| 4,573,506 | A * | 3/1986 | Paoletti | 141/98 |
| 4,643,309 | A * | 2/1987 | Evers | 206/484 |
| 5,348,550 | A * | 9/1994 | Ikeda et al. | 604/411 |
| 5,454,805 | A * | 10/1995 | Brony | 604/406 |
| 5,620,434 | A * | 4/1997 | Brony | 604/406 |
| 6,056,135 | A | 5/2000 | Widman | |
| 6,179,823 | B1 | 1/2001 | Niedospial, Jr. | |

FOREIGN PATENT DOCUMENTS

| | | | |
|---|---|---|---|
| DE | 2 023 395 | A | 11/1971 |
| DE | 198 07 847 | A1 | 8/1999 |
| DE | 101 14 423 | A | 10/2002 |
| EP | 0 542 295 | A | 5/1993 |
| EP | 0 706 487 | B1 | 9/2000 |
| GB | 693434 | | 7/1953 |
| GB | 2 208 227 | A | 3/1989 |
| GB | 2 268 482 | A | 1/1994 |
| WO | WO 95 17874 | A | 7/1995 |
| WO | WO95 17874 | A | 7/1995 |
| WO | WO 02 085429 | A | 10/2002 |

* cited by examiner

*Primary Examiner*—Timothy L. Maust
(74) *Attorney, Agent, or Firm*—Rothwell, Figg, Ernst & Manbeck, P.C.

(57) ABSTRACT

A bottle neck liner, the liner comprising a sleeve terminating in an inward step, the inward step preventing the barrel of a syringe from protruding past the step when the syringe is inserted into the sleeve. Once the syringe is inserted the bottle may be inverted and liquid may be drawn into the syringe. Additionally, bottles, liquid dispensing apparatus and methods of dispensing liquids, all involving the provision of such a step in the bottle neck.

11 Claims, 2 Drawing Sheets

LIQUID DISPENSING

CROSS REFERENCE TO RELATED APPLICATION

This application is a 35 USC § 371 National Phase Entry Application from PCT/GB2003/004850, filed Nov. 10, 2003, and designating the United States.

FIELD OF THE INVENTION

This invention relates to bottle neck liners, bottles, liquid dispensing apparatus and methods of dispensing liquids.

BACKGROUND TO THE INVENTION

The administration of liquids from many bottles, such as medicine bottles, normally requires that an accurately prescribed amount is measured. Such measures may be described in terms of teaspoonfuls, tablespoonfuls, drops, or even more accurately, millilitres; all of which may be measured by pouring from the medicine bottle onto a spoon or into a measuring receptacle. When it is desired to dispense the medicine in very accurate millilitre amounts, it is normally necessary for an accurate subsidiary measuring device to be used, such as a graduated syringe or pipette.

With conventional medicine bottles, the bottle neck is free for a syringe to be inserted through the bottle neck and into the bottle. The syringe is generally dipped into the liquid in the bottle, and the plunger of the syringe pulled up by a user in order to withdraw liquid into the body of the syringe. Often, it is difficult to see the graduations on a syringe body in order for a user to determine exactly how much liquid has been withdrawn. Thus, commonly a user will withdraw a portion of liquid, check that the right amount of liquid has been withdrawn, and if not will return the syringe to the liquid to withdraw and eject more liquid in order to obtain the correct prescribed amount.

Thus, conventional methods of withdrawing liquids from bottles using syringes is problematical in that it is difficult to determine an accurate amount of liquid being withdrawn in a single operation into the syringe. Furthermore, as the syringe is dipped into the liquid, any microorganisms on the body of the syringe may be introduced into the medicine, which may potentially contaminate the medicine.

The problem of withdrawing a prescribed amount of medicine from the bottle using a syringe which is dipped into liquid in the bottle, is exacerbated when the bottle is of the type having a coloured glass, such a brown glass. Coloured glasses are commonly used where the medicinal contents are photosensitive, and it is desired to protect the medicine from ambient light when the medicine bottle is removed from a medicine cabinet or the like. If the medicine bottle has coloured glass, it can be very difficult or impossible to see through the glass to determine whether a prescribed amount of liquid has bee withdrawn into a syringe. The graduations on the syringe body may be very difficult to determine through the coloured glass.

The act of dipping a syringe into the liquid in a medicine bottle also coats the outside of the syringe body with the medicine, and as the syringe is withdrawn from the bottle, the liquid coating on the syringe body may drip from the body onto the user or any surface around the user. This may necessitate cleaning of clothing, floors, surfaces etc.

It would therefore be advantageous to provide a liquid dispensing apparatus in which a syringe can be used to withdraw a liquid from a bottle, but such that the syringe, and especially graduations on it, are visible to a user without occlusion by the bottle. It would be also advantageous to provide a liquid dispensing apparatus in which a minimum surface area of the syringe contacts the liquid in the bottle in order to minimise potential contamination of the liquid in the bottle by micro organisms from the syringe, and which minimises the amount the syringe body which can be covered in liquid, to reduce the possibility of spillages onto a user and/or a surface around the user. Furthermore, it would be advantageous to provide a bottle incorporating all of the above mentioned advantages, and in which, if it is desired not to use a syringe, liquid can be poured from the bottle in a conventional fashion without undue obstruction of the liquid through the bottle neck due to complicated caps and/or inserts.

It is therefore an aim of preferred embodiments of the invention to overcome or mitigate the problems of the prior art whether expressly disclosed herein or not.

SUMMARY OF THE INVENTION

According to a first aspect of the present invention there is provided a bottle neck liner so dimensioned that it can be sealingly located within a bottle neck, the liner comprising a sleeve defining a bore having an inward step, the sleeve and step being so dimensioned that, in use, the bore can sealingly accommodate the distal end region of a syringe barrel with the distal end of the syringe barrel in abutment with the inward step, the distal end region of the syringe barrel being thereby located substantially within the bottle neck.

By "syringe" we mean a syringe comprising a hollow syringe barrel in which is located, or arranged to be located, a reciprocating plunger, the syringe barrel having a dispensing aperture, through which a liquid may be drawn, then discharged.

Preferably the syringe is a flat-nosed syringe.

By "flat-nosed syringe" we mean a syringe whose barrel ends in a generally flat distal end which is perpendicular to the barrel axis, and in which the dispensing aperture is formed. Preferably there is no part of the distal end which extends beyond the bore.

By "sealingly" we mean that under conditions of normal use liquid cannot flow or leak between the respective parts, that is, between the bottle neck and the bottle neck liner, and between the bore and a syringe barrel.

Preferably liquid can flow into the syringe once located in the bore, only through an aperture defined inwardly of the inward step. Preferably such an aperture is pre-formed and permanently open; preferably it is not formed in situ on introduction of the syringe, as by a piercing or spreading action.

Preferably the syringe has no formation or fitment at its distal end, such as would create or spread open an aperture within the liner.

Preferably the sleeve is dimensioned to fit, in use, substantially entirely within a bottle neck, more preferably entirely within a bottle neck. Thus the sleeve preferably does not protrude past the bottle neck, into the body of the bottle, when fitted to the bottle.

Preferably the sleeve comprises a resilient material. Suitably the sleeve comprises a resilient plastics material. Preferred materials are polyolefins, especially polyethylene and/or polypropylene.

Preferably the sleeve is, or is part of, an injection moulding.

Suitably the through bore defined by the sleeve is of unchanging cross-section (except in the region of the inward step or flared portion, where provided; both as described separately herein). However in some embodiments the through bore may have a slight taper, to ensure a tight fit of the barrel within the through bore.

Preferably bore of the sleeve is of circular cross-section.

Suitably the sleeve comprises a resilient material and is dimensioned such that in use it can resiliently grip the distal end region of the syringe barrel inserted into the bore. To this end the through bore may have a slight taper, as previously described, or, preferably, the bore may be slightly undersized, relative to the syringe barrel.

Preferably the sleeve is formed with a flared portion at its end into which the distal end of a syringe barrel passes, to provide a lead-in, into the through bore, in order to aid engagement of the syringe barrel into the through bore.

The inward step may comprise one or more protrusions extending inwardly from the sleeve. There may be two or more protrusions, preferably in one or more diametrically opposed pairs.

Preferably the inward step is a substantially annular inward step.

Preferably the inward step or each inward protrusion is transverse, more preferably substantially perpendicular, to the sleeve body.

Suitably the inward step is located in the region of one end of the sleeve, the end-which in use is at the lower end of the bottle neck; preferably substantially at that end; that is, at the very end of the sleeve.

Thus the inward step prevents, in use, a syringe barrel inserted into the liner from moving past the bottle neck. The barrel thus inserted is sealingly received within the sleeve and the inward step limits its movement, on insertion.

Thus in a preferred embodiment the sleeve is comprised by a resilient plastics body defining a through bore, the body being dimensioned to fit substantially entirely, and sealingly, within a bottle neck, the sleeve comprising, substantially at one end thereof, an inward step.

The sleeve may comprise an outwardly protruding flange extending around at least a portion of an end of the sleeve. Preferably, when the inward step is located at or in the region of one end of the sleeve, the flange is located at the other end of the sleeve. Suitably the outwardly protruding flange extends entirely around the sleeve.

Suitably the flange is integral with the sleeve.

Preferably the outwardly protruding flange extends transverse, preferably substantially perpendicular, to the sleeve.

The liner may comprise an outer body located around the sleeve and connected to it, preferably by connection in the region of the end of the sleeve not comprising the inward step. Preferably there is a web of material constituting the connection, which is the only connection between the outer body and the sleeve. Thus the outer body and the sleeve may be somewhat more flexible at the end remote from the web that at the end with the web. This flexibility can assist in obtaining the sealing connections mentioned elsewhere.

Preferably the web extends around the whole gap between the outer body and the sleeve; that is, it is preferably one continuous band.

Preferably the web is at one end of the sleeve and the inward step is at the other.

The outer body is preferably spaced from the sleeve.

Preferably the outer body is circularly cylindrical.

The outer body and the sleeve are preferably concentric.

A chamber, preferably annular, is preferably defined between the outer body and the sleeve.

Suitably the outwardly protruding flange extends from the outer body of the liner.

Preferably the flange is an outward continuation of the web.

Preferably the free edge of the outer body (that is, the part of the outer body which first enters the bottle neck) has a taper on its outer surface, such that it functions as a lead in, to facilitate fitting of the liner into the bottle neck, during manufacture.

Preferably the outer body is slightly oversized relative to the bottle neck into which it will be fitted. The intention is to achieve a firm interference fit, such that the parts will not separate in use. Thus, the force required to withdraw the liner from the bottle neck preferably exceeds the force required to withdraw a syringe barrel from the sleeve into which it is inserted.

When the sleeve comprises an outer body, preferably the outer body is dimensioned to sealingly fit a bottle neck, in use.

Preferably the flange is dimensioned such that, in use, the underside thereof is capable of abutting the rim of a bottle neck, and preferably is dimensioned such that it does not protrude laterally, beyond the rim of the bottle neck.

According to a second aspect of the present invention there is provided a bottle having a bottle neck in which is located a bottle neck liner such that liquid cannot flow between the bottle neck liner and the bottle neck, the bottle neck liner comprising a sleeve comprising an inward step located within the bottle neck, wherein the sleeve is dimensioned such that when a syringe barrel is inserted into the sleeve liquid cannot flow between the sleeve and the barrel, and wherein the inward step is so located as to prevent the syringe barrel from protruding past the step.

Preferably the sleeve is such that the barrel able to be received by it is a barrel of a flat-nosed syringe.

Preferably the sleeve does not substantially protrude from the bottle neck, into the main volume of the bottle.

Suitably the liner is as described hereinabove in relation to the first aspect of the invention.

Suitably the bottle includes a closure member, preferably a bottle cap or lid. Preferably the liner is dimensioned such that the closure member may be removably attached to the bottle neck, without removal of the bottle neck liner. The closure member is preferably childproof. Tamper-evident means is preferably provided to provide a visual indication of the first removal of the closure member from the bottle.

Suitably the bottle neck comprises an external screw thread, arranged in use, to cooperate with a corresponding screw thread on the bottle closure member.

The bottle could be any bottle from which it is desired to extract a liquid, but is preferably a bottle containing liquid medicine, for example for the relief of colds, coughs, sore throats, fevers, influenza or pain.

According to a third aspect of the present invention there is provided a bottle having a bottle neck, wherein the bottle neck comprises an inward step, the inward step being dimensioned to prevent the barrel of a syringe from protruding past the step when the barrel of the syringe is sealingly inserted into the bottle neck.

The syringe may be as described above.

The annular step may be as described above, except that it is carried by the bottle neck itself and not, in this embodiment, by a bottle neck liner.

According to a fourth aspect of the present invention there is provided a liquid dispensing apparatus comprising a bottle of the second or third aspect of the invention, and a syringe having a plunger and a barrel which is arranged in use to be sealingly inserted into the bottle when an aliquot of liquid is required, the apparatus being such that when the barrel is thus inserted liquid can leave the bottle only via the syringe.

According to a fifth aspect of the present invention there is provided a method of dispensing a liquid using liquid dispensing apparatus of the fourth aspect of the invention, the method comprising the steps of:

(a) providing a syringe comprising a syringe barrel which has a fluid dispensing aperture at the distal end thereof;
(b) inserting the barrel into the bottle neck of the bottle until the distal end of the barrel abuts the inward step;
(c) positioning the bottle such that liquid within the bottle contacts the aperture;
(d) effecting outward movement of a plunger of the syringe to withdraw liquid from the bottle into the barrel;
(e) positioning the bottle such that liquid within the bottle no longer contacts the aperture;
(f) removing the barrel from the bottle neck; and
(g) effecting inward movement of the syringe plunger to dispense liquid from the syringe barrel.

Preferably step (b) comprises inserting the syringe into the bottle neck until the distal end of the barrel abuts the inward step.

Step (c) may comprise tilting the bottle at a necessary angle, preferably such that the bottle neck is located substantially below the body of the bottle or more preferably, comprises inverting the bottle.

Preferably the method is a method of dispensing a medicinal liquid from a bottle of the second aspect of the invention. Thus the bottle neck preferably comprises a liner.

Thus, in a preferred embodiment a liquid dispensing apparatus and associated method is provided wherein, in use, a liquid in the bottle may be dispensed from the bottle conventionally by tilting the bottle such that liquid in the bottle flows through the through bore in the sleeve of the liner. However, when it is desired to dispense more accurately prescribed amounts of a liquid, or to dispense a liquid without mess, a syringe can be sealingly inserted into the liner until the distal end of the syringe barrel abuts the inward step of the sleeve, and is prevented from moving further into the bottle. The bottle is tilted or inverted such that the liquid abuts the aperture of the syringe barrel and the plunger of the syringe is moved outwards until the desired amount of liquid is withdrawn into the syringe barrel. The bottle can then be returned to a non-dispensing position, and the syringe withdrawn from the liner in order to dispense the prescribed amount of liquid. In neither method of use can liquid flow between the bottle neck and the bottle neck liner.

Thus a bottle is provided from which liquid can be dispensed in a conventional manner, and also prescribed amounts of liquid can be delivered using a syringe; and in which no components need to be inserted into or removed from the bottle or bottle neck in order to switch between the dispensing methods. The use of a flat-nosed syringe and an inward step in the bottle liner also minimises the contact of the liquid with the syringe barrel, thereby also minimising the scope for contamination of the liquid from microorganisms on the syringe barrel. The outside of the syringe barrel is not coated in the liquid, thus minimising cleaning of the syringe, and dripping of liquid from it. As the bottle liner is such that the barrel of the syringe fits sealingly into the sleeve, substantially no liquid leaks from the bottle when the syringe is inserted and the bottle tilted or inverted. The only exit route for liquid is the through bore of the liner, by one or other of the methods described above.

BRIEF DESCRIPTION OF THE DRAWINGS

In order to better understand the various aspects of the invention, and to show embodiments of the same may be put into effect, the invention will now be described by way of example, with reference to the accompanying drawings in which.

Figure 1:
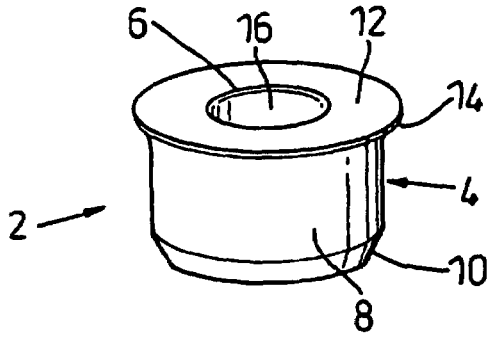
FIG. 1 illustrates a side elevational view of a preferred embodiment of a bottle neck liner of the first aspect of the invention.
Figure 2:
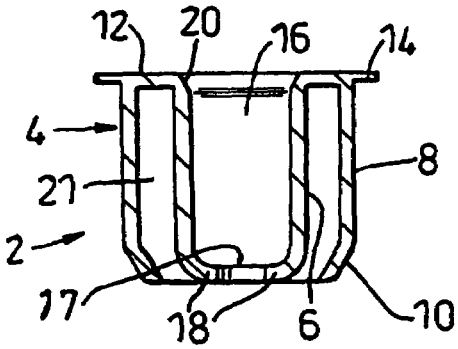
FIG. 2 illustrates a side sectional view of the bottle neck liner of FIG. 1.

We refer firstly to FIGS. 1 and 2. A preferred embodiment of a bottle neck liner 2 of the first aspect of the invention comprises a sleeve 4 comprising circularly cylindrical wall 6 around which is located, in spaced-part relation, a circularly cylindrical concentric outer body 8 having at one end an outer taper or chamfer 10. The sleeve 4 and outer body 8 are connected at their upper ends by a top wall 12 which includes an outwardly protruding annular flange 14 which connects to the outer body 8 in the region of the chamfer.

The sleeve 4 has a circularly cylindrical through bore 16. The sleeve 4 includes at the lower end thereof an inward step 18. This is an annular formation protruding inwardly from the interior surface of the sleeve 4 at its lower end, and terminating in a circular aperture 17. At its upper end the sleeve is inwardly bevelled at 20.

There is an annular space 21 between the outer body 8 and the sleeve 4. It will be seen that the outer body 8 and the sleeve are connected only at the upper end of the liner, by means of the top wall 12.

The bottle neck liner 2 is a one-piece injection moulding from a resilient plastics material, typically of polypropylene or polyethylene.

Use of the bottle neck liner 2 will now be described with reference to FIG. 3 to 6. The bottle neck liner 2 is inserted into a bottle 22, which is preferably a medicine bottle for dispensing a viscous liquid medicine. The bottle is formed at its upper end with a cylindrical narrowed bottle neck 24, which is itself formed with an external screw thread 26. The bottle neck liner 2 is push fitted into the bottle neck 24 until the flange 14 of the bottle neck liner 2 abuts the rim of the bottle neck 24. At this point the bottle neck liner cannot be pushed further into the bottle neck 24. The bottle neck liner is dimensioned such that the sleeve 4 does not protrude past the bottle neck 24 and into the main body 28 of the bottle 22. The resilient nature of the plastics material of the bottle neck liner 2 means that as the liner is pushed into the bottle neck 24 the outer body 8 is deformed inwardly, and provides a sealing fit between the outer body 8 and the bottle neck 24. Thus, if the bottle 22 is inverted, no liquid can flow between the outer body 8 and the internal surface of the bottle neck 24.

The flange 14 of the bottle neck liner 2 is dimensioned such that it has a diameter substantially identical to the diameter of the top surface of the bottle neck 24, and does not protrude to a significant degree past the bottle neck 24. Thus, a closure means such as a bottle cap (not shown) may be screwed onto the outer screw thread 26, over the bottle neck 24 and the bottle neck liner 2 within it, in order to sealingly close the bottle neck 24, for transportation, sale and storage.

Figure 4:
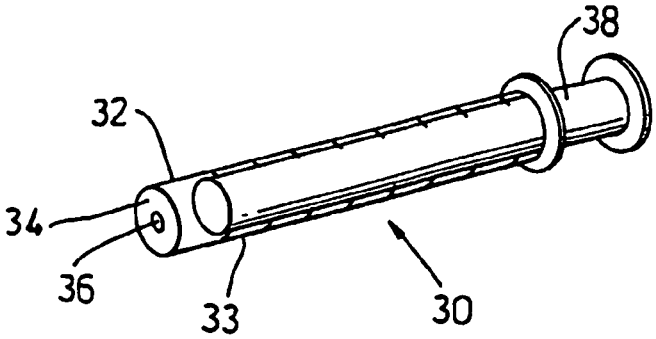
FIG. 4 illustrates a flat-nosed syringe, arranged in use to be inserted into the bottle neck liner of FIGS. 1 and 2.

We refer now to FIG. 4 which illustrates a flat-nosed syringe 30 for use in the present invention. The flat-nosed syringe 30 includes a hollow circularly cylindrical syringe barrel 32 having a distal end region 33 to be received in the liner, and terminating in a perpendicular, circular face at its distal end 34, formed with a centrally located dispensing aperture 36. The syringe 30 also includes a plunger 38 arranged to move under reciprocal motion within the syringe barrel 32.

Figure 3:
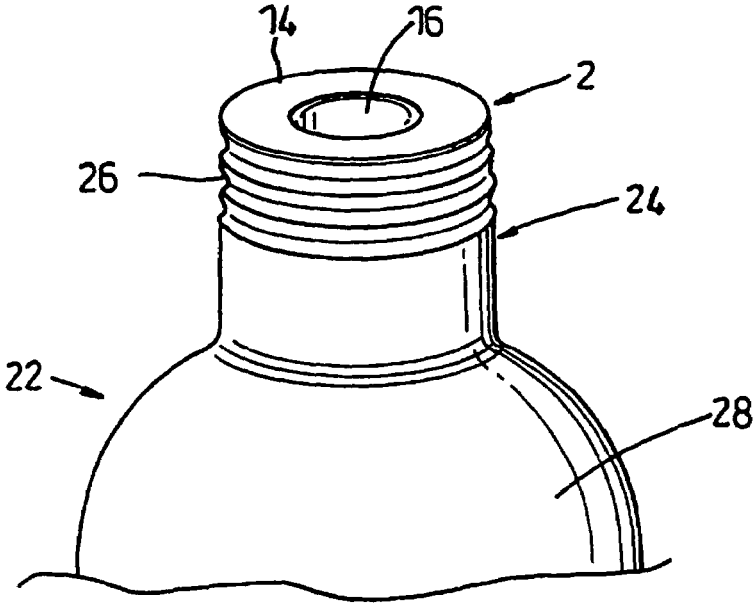
FIG. 3 illustrates the bottle neck liner of FIGS. 1 and 2 inserted into the bottle neck of a bottle.
Figure 5:
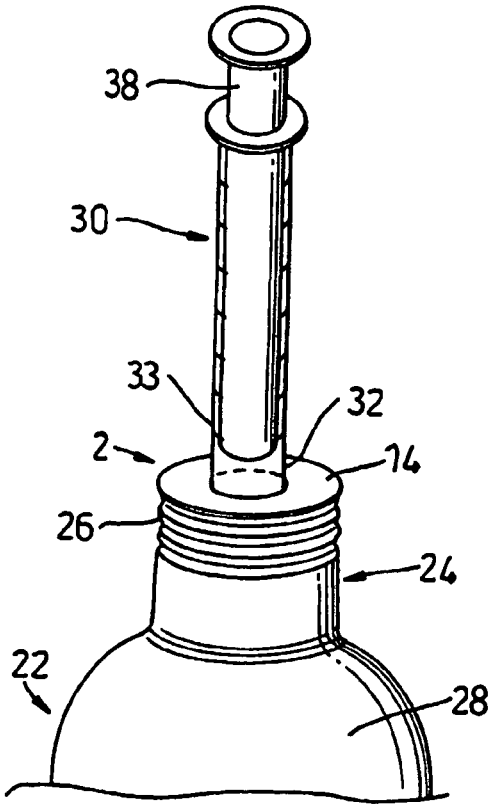
FIG. 5 illustrates the syringe of FIG. 4 inserted into the bottle of FIG. 3.

In order to accurately dispense liquid from the bottle of FIG. 3, the syringe barrel 32 is inserted into the bottle neck liner 2, as shown in FIG. 5.

Figure 6:
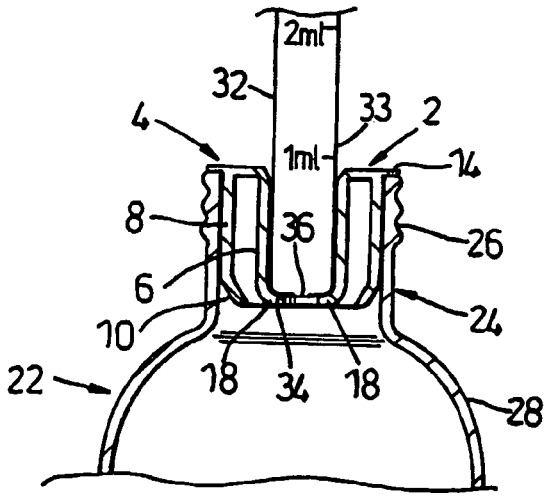
FIG. 6 illustrates a side sectional view of the syringe, bottle neck liner and bottle taken through the line AA of FIG. 5.

We refer now to FIG. 6. As the distal end region 40 of the barrel is inserted into the bottle neck liner 2, it pushes slightly against the sleeve 4, the cross-section of the bore 16 of the latter being slightly smaller than the cross-section of the barrel. Good sealing against the passage of liquid between the barrel and the sleeve is thereby provided. The insertion continues until the distal end 34 of the syringe barrel 32 abuts the inward step 10 of the sleeve 6 (see FIG. 6). In this position, the distal end region of the syringe barrel is a tight sealing fit within the sleeve inside the bottle neck 24, but the rest of the syringe barrel—the larger part—is not; it stands outside the bottle. Thus, graduations on the syringe barrel 32 can still be seen by a user. The seals between the liner 2 and the bottle neck 24, and the syringe barrel 32 and the sleeve 4, prevent leakage of liquid between such parts if the bottle is tilted or inverted. The dispensing aperture 36 of the syringe barrel 32 is located centrally and contiguously with the opening within the inward step 10 of the sleeve 4.

In use, in order to accurately measure and dispense an aliquot of liquid from the bottle 22, the bottle is tilted, or preferably inverted, and the plunger 38 of the syringe 30, previously stowed inside the barrel, is withdrawn until the prescribed aliquot of liquid has been drawn from the bottle 22, via aperture 17, into the syringe barrel 32, as measured by the graduations on the syringe barrel 32. The bottle may then be placed upright again, and the syringe 30 withdrawn from the bottle neck liner 2 in order to dispense the prescribed quantity of liquid now present in the syringe barrel 32.

Because only a small portion of the distal end 34 of the syringe barrel 32 is exposed to liquid upon inversion or tilting of the bottle 22, there is a low risk of contamination of the liquid through the agency of the syringe. A minimal amount of liquid is left on the syringe barrel 32, at the end of the procedure. Indeed, only a small portion of the external surface of the barrel 32—merely a portion of the flat distal end 34, itself small—is exposed to liquid. In addition to the contamination benefit spillage from liquid dripping from the syringe barrel 32 is unlikely. Further, the exterior of the bottle neck can remain clean, using this method.

If it is desired to dispense a larger quantity of liquid, or if accurate dispensing is not needed, the bottle neck liner 2 allows for simple pouring of liquid from the bottle into a suitable receptacle such as a spoon or medicinal measuring cup. The syringe 30 is not used in this method, and the bottle is simply tilted or inverted such that liquid may flow through the annular space 21 formed within the inward step 10 of the bottle neck liner 2, and out of the bottle neck liner 2. Thus the liquid dispensing apparatus exemplified in FIG. 1 to 6, can be used to dispense accurate aliquots of liquid through the flat-nosed syringe 18, or doses of liquid through the opening in the bottle neck liner 2, in the traditional way.

In an alternative embodiment the bottle does not comprise a bottle neck liner having an inward step, but instead the bottle neck itself includes an inward step, such as an annular inward step, dimensioned to prevent the body of a flat-nosed syringe from protruding past the bottle neck, into the bottle, when inserted into the bottle neck.

The invention claimed is:

1. A liquid dispensing apparatus comprising a bottle, a bottle neck liner and a flat-nosed syringe having a plunger and a barrel, the barrel terminating at its distal end in a generally flat face having a diameter corresponding to the diameter of the syringe barrel and being a perpendicular to the longitudinal axis of the barrel, the bottle having a bottle neck in which is located the bottle neck liner having a cylindrical body sealingly engaged inside the bottle neck such that liquid cannot flow between the bottle neck liner and the bottle neck, the bottle neck liner comprising a sleeve comprising at its lower end an inward step located within the bottle neck, an aperture being defined inwardly of the inward step, wherein the cylindrical body and the sleeve are connected together with a web of material only at the upper end of the cylindrical body and of the sleeve, wherein the sleeve is formed with a flared portion at its upper end into which the distal end of the syringe barrel passes; wherein when the syringe barrel is inserted into the sleeve the inward step prevents the syringe barrel from protruding past the step and liquid cannot flow between the sleeve and the barrel, but can leave the bottle only via the aperture and thence the syringe.

2. A liquid dispensing apparatus as claimed in claim 1, wherein the aperture is pre-formed and permanently open.

3. A liquid dispensing apparatus as claimed in claim 1, wherein the bottle neck liner has a cylindrical body to engage sealingly inside the bottle neck, wherein the sleeve is spaced from the body, wherein the body and sleeve are connected together by a web of material only at one end of the body and of the sleeve; and wherein at the other end of the sleeve the inward step is located.

4. A liquid dispensing apparatus as claimed in claim 1, wherein the sleeve comprises a resilient material.

5. A liquid dispensing apparatus as claimed in claim 1, wherein the inward step is a substantially annular inward step.

6. A liquid dispensing apparatus as claimed in claim 1, wherein the inward step is located in the region of one end of the sleeve.

7. A liquid dispensing apparatus as claimed in claim 1, wherein the liner comprises an outwardly protruding flange extending around at least a portion of an end of the liner and abutting the rim of the bottle neck into which the liner is inserted.

8. A liquid dispensing apparatus as claimed in claim 1, wherein the bottle contains liquid medicine.

9. A liquid dispensing apparatus as claimed in claim 1, wherein the bottle includes a closure member which can be secured over the bottle neck.

10. A method of dispensing liquid from liquid dispensing apparatus as claimed in claim 1, the method comprising the steps of:

(a) inserting the barrel of the syringe into the bottle neck of the bottle until the distal end of the barrel abuts the inward step;

(b) positioning the bottle such that liquid within the bottle contacts the aperture;

(c) effecting outward movement of a plunger of the syringe to withdraw liquid from the bottle into the barrel;

(d) positioning the bottle such that liquid within the bottle no longer contacts the aperture;

(e) removing the barrel from the bottle neck; and (f) effecting inward movement of the syringe plunger to dispense liquid from the syringe barrel.

11. In combination, a flat-nosed syringe and a bottle neck liner, able to produce, with a bottle, a liquid dispensing apparatus as claimed in claim 1.

* * * * *